US005115865A

United States Patent [19]

Carisella et al.

[11] Patent Number: 5,115,865

[45] Date of Patent: May 26, 1992

[54] METHOD AND APPARATUS FOR SELECTIVELY ACTUATING WELLBORE PERFORATING TOOLS

[75] Inventors: James V. Carisella, 7524 Garnet, New Orleans, La. 70124; Robert B. Cook, Mandeville, La.

[73] Assignee: James V. Carisella, New Orleans, La.

[21] Appl. No.: 723,946

[22] Filed: Jul. 1, 1991

Related U.S. Application Data

[62] Division of Ser. No. 538,840, Jun. 15, 1990, Pat. No. 5,052,489.

[51] Int. Cl.[5] ..... E21B 43/11

[52] U.S. Cl. ..... 166/297; 166/55; 337/145

[58] Field of Search ..... 166/55, 65.1, 297, 298; 175/3.5, 4.50, 4.51, 4.53–4.56, 4.6; 337/145; 338/51, 295

[56] References Cited

U.S. PATENT DOCUMENTS

| | | | |
|---|---|---|---|
| 1,380,049 | 5/1921 | Fearn | 337/145 |
| 2,363,234 | 11/1944 | Doll | 175/4.55 |
| 2,961,958 | 11/1960 | Toomey et al. | 337/145 |
| 3,517,758 | 6/1970 | Schuster | 175/4.55 |
| 4,169,999 | 10/1979 | Kishel | 337/145 X |

FOREIGN PATENT DOCUMENTS

| | | | |
|---|---|---|---|
| 1004622 | 3/1983 | U.S.S.R. | 166/55 |

*Primary Examiner*—Ramon S. Britts
*Assistant Examiner*—Roger J. Schoeppel
*Attorney, Agent, or Firm*—E. R. Archambean, Jr.

[57] ABSTRACT

In the representative embodiments of the several methods and apparatus of the invention disclosed herein, a movable detonating member is arranged to be selectively impelled against an impact-responsive detonator on a well bore perforator having one or more explosive devices. The movable detonating member is initially restrained from moving in relation of the tool body by a heat-responsive material which, in one embodiment, is operative to release the detonating member when an electrical heater on the tool is initiated from the surface for melting the bonding material or, in another embodiment, releases the detonating member when the material melted by elevated well bore temperatures. Other safety measures disclosed herein include temperature-sensitive barriers which, in one embodiment, prevents the movement of the detonating member against the explosive detonator until the material in the barrier is changed by elevated well bore temperatures as well as a second embodiment that precludes the transmission of detonating forces from the detonator and other explosives in the train of explosives on the bore perforator.

27 Claims, 2 Drawing Sheets

METHOD AND APPARATUS FOR SELECTIVELY ACTUATING WELLBORE PERFORATING TOOLS

This application is a division of U.S. application Ser. No. 538,840 filed Jun. 10, 1990, now U.S. Pat. No. 5,052,489.

BACKGROUND OF THE INVENTION

Electrically-actuated devices are widely employed with many types of wireline tools which are selectively actuated from the surface. One of the common uses for such electrically-initiated control devices is to selectively actuate explosive devices on such typical well tools as perforating guns, cutting tools, dump bailers, sample takers and backoff tools which are dependently supported in a borehole or well bore by so-called "wireline" or a suspension cable having electrical conductors connected to a surface power source. Once the tool is positioned at a desired depth location in a well bore, the power source is operated for supplying power to an electrically-actuated detonating system on on the tool for setting off the explosive devices on the tool.

Although there is a wide variety of wireline tools equipped with electrically-actuated detonating systems and various types of explosive devices, these detonating systems are fairly similar inasmuch as they are basically comprised of a blasting cap or an electrically-responsive initiator or detonator having a sensitive primary explosive, such as lead azide, cooperatively arranged to set off a powerful secondary explosive, such as RDX, which, in turn, detonates the explosive devices on the tool. For example, a typical wireline perforator has an electrically-responsive detonator which is cooperatively arranged to set off a first explosive device such as a booster charge or a detonating cord. This first explosive device is, in turn, arranged in detonating proximity of one or more second explosive devices such as shaped explosive charges which are appropriately mounted on the tool for perforating the well casing and earth formations.

Premature actuation of any of these wireline tools must, therefore, be avoided if possible.

One of the most common sources for the premature actuation of wireline tools with electric detonators is, of course, the careless application of power to the cable conductors after the well tool is connected to the suspension cable and the tool is still at the surface. To at least minimize these risks, the installation of the detonators into the tool as well as the final connection of their electrical leads will be delayed as long as is reasonably possible. Added protection is also provided by controlling the surface power source with a key-operated switch that is not unlocked until the tool is situated at a safe depth.

Perforators have also been protected heretofore by one or more switches in the downhole electrical firing circuit of the perforator which will not be closed until a movable member on the perforator body has been moved outwardly against the adjacent casing wall. Other prior-art disarming devices have included pressure-actuated switches in the downhole firing circuit which are not activated until the perforator is safely disposed at a depth where the downhole pressure is greater than a predetermined level. Another prior-art protective device is described in U.S. Pat. No. 3,517,758 as having an arming switch in the downhole firing circuit which has a spring-biased movable contact member that is initially held in an inactive position by a destructible link such as a typical carbon resistor. Then, when it is desired to activate the arming circuit for a perforator, a current of a predetermined magnitude is passed through the carbon resistor for a sufficient length of time to weaken or destroy the resistor and thereby release the spring-biased switch contact for movement so as to activate the downhole electrical circuit of the perforator.

These procedures will, of course, greatly reduce the hazard of inadvertently detonating the explosive devices in these tools while they are at the surface. Nevertheless, a major hazard is that the electrical detonators commonly used for oilfield explosive tools are susceptible to being inadvertently detonated by strong electromagnetic fields. Another source of premature actuation of these detonators is also the unpredictable presence of so-called "stray voltages" which may sporadically appear in the structural members of the drilling platform. Such stray voltages are not ordinarily present; but these voltages are frequently created by power generators on the drilling rig, cathodic protection systems for the structure or galvanic corrosion cells that may be present at various locations in the structure. Lightning also may set off these detonators. At times there may be hazardous voltage differences existing between the wellhead, the structure of the drilling rig and the equipment used to operate the tools.

Many of these hazards may also be present when a well tool having an unfired detonator and one or more unexpended explosive devices is removed from the well bore. This situation itself represents an additional hazard since it is not always possible to know if there is an unexpected electric detonator remaining in that tool. It should be appreciated that everyone who is in the vicinity will be well aware of the potential danger when any tool with explosive devices is being retrieved. Thus, even low-order detonation of explosive devices on a tool being retrieved can be a problem since nearby personnel will overreact to the sudden noise and possibly injure themselves or damage equipment as they are seeking safety.

Because of these potential hazards that exist once a tool is armed, many proposals have been made heretofore for appropriate safeguards and precautions for handling these tools while they are at the surface. For instance, when a tool with an electric detonator is being prepared for lowering into a well, in keeping with the susceptibility of detonators to strong electromagnetic fields it usually necessary to maintain strict radio silence in the vicinity. Ordinarily a temporary restriction on nearby radio transmissions will not respresent a significant problem on a land rig. On the other hand, when service tools with explosives are being used on a drilling vessel or an offshore platform, it is a common practice to at least restrict, if not prohibit, radio and radar transmissions from the platfrom as well as from helicopters and surface vessels in the vicinity. Similarly, it may be best to postpone electrical welding operations on the rig or platform since welding machines may develop currents in the structure that may inadvertently initiate a sensitive electrical detonator in an unprotected well tool at the surface.

It will, of course, be realized that a large amount of time is frequently lost when a well tool having electrically-actuated explosive devices is being prepared for operation since ancillary operations that are not related to the service operation are also typically curtailed. For example, the movements of personnel and equipment by helicopters and surface vessels must be restricted to avoid radio and radar transmissions which might set off one of the detonators. Thus, the relative priorities of the proposed service operation and these movements must be taken into account to decide which operations must be curtailed in favor of the higher-priority tasks. These problems relating to operations on one drilling rig may also similarly affect operations on other offshore rigs in the vicinity. Accordingly, if there are a large number of platforms or drilling vessels situated in a limited geographical area, the activities on all drilling rigs in that area must be coordinated to accommodate the service operations in the affected area. The various delays and the related logistical problems associated with these activities will, of course, have an obvious effect on the expenses and the time requirements for the drilling and service operations in that particular field.

In view of these problems, various proposals have been made heretofore to disarm a well tool by temporarily interrupting the explosive train at some point between the initiating explosive device and the other explosive devices. One of the most common proposals has been to position a removable detonation-attenuating barrier between the initiator or donor explosive of the detonator and the adjacent receptor explosive. The detonator is thereafter armed by simply removing the barrier just before the well tool is lowered into the well bore. Other proposed disarming devices employ an axially-movable or a rotatable barrier that is normally positioned to interpose a solid wall between the spaced donor and receptor explosives. To arm the tool, the barrier is manipulated for moving an opening in the barrier into alignment with the explosives. It must be appreciated, however, that despite the effectiveness of these barriers, once a barrier is moved the well tool becomes vulnerable to inadvertent actuation.

Regardless of the particular wireline tool that is involved, it must be realized that even when the tool is in a well bore and thereby shielded against radio or radar signals, an electric detonator can be inadvertently fired should sufficient voltage be prematurely applied in any way to the conductors in the tool suspension cable.

Outside of the oilfield industry, other disabling devices have also been proposed heretofore in such diverse fields as fire sprinklers and military ordinance. These devices typically have various arrangements of spring-loaded detonating pins which are releasably retained in ineffective positions by explosive squibs, bimetallic elements or an erodible retainer that is responsive to prolonged exposures to a corrosive environment. However, these devices simply have little or no application for oilfield tools. For instance, the delay times for these disabling devices are either so short or unpredictable that they would be unusable in the oilfield. Other devices have been proposed to utilize electronic compensators to accommodate for the variations in the surrounding environment. Those latter devices are typically so imprecise and delicate that they would be totally inadequate for selectively controlling electrically-actuated explosive devices in a wireline tool.

Impact-detonated tools have also employed barriers of frictionally-insensitive inert materials such as consolidated talc and the other materials listed in U.S. Pat. No. 2,857,847 to limit the penetration of a firing pin through the barrier. It is, of course, readily recognized that those barriers are used only for controlling the depth of penetration of the firing pin and are effective immediately without any reference whatsoever to the ambient temperature of the barrier material.

Despite the large number of different safety procedures and devices described above, these systems are still incapable of reliably and safely operating well tools that have explosive devices that are to be actuated by means of remote electrical or mechanical means. Instead, it has been necessary to rely upon complicated fail-safe actuators with the unwarranted expectation that all of the fail-safe devices on a particular tool will always properly perform to prevent the malfunction of the tool during a given operation. Moreover, none of these safety devices are completely suited for use with different types of well tools. The safety devices which are currently in use are substantially tailor-made for a particular tool; and, therefore, few of those prior-art safety devices or electrically-actuated detonating systems can be utilized on other types of tools without extensive redesign or modification of a particular detonating system or its related tool. It also appears that none of these prior-art systems have had at least two fail-safe features which is wholly fool-proof and reliable.

OBJECTS OF THE INVENTION

Accordingly, it is an object of the present invention to provide new and improved methods and apparatus for selectively initiating various well bore perforators from the surface.

It is a further object of the present invention to provide new and improved selectively-actuated control systems which are unaffected by extraneous voltages or radio or radar signals.

It is an additional object of the invention to provide new and improved actuating systems which can not be accidentally set off by spurious electrical energy and can be interchangeably employed with various well bore perforators.

It is another object of the present invention to provide methods and apparatus for rendering explosively-actuated perforators inoperable until those tools have been exposed to elevated temperatures in a well bore for a finite time period.

It is a further object of the present invention to provide methods and apparatus for enabling explosively-actuated perforators only when those tools have been exposed to elevated well bore temperatures in a well bore for a finite time period and then rendering the tools inoperable should they be returned to the surface without having been operated properly.

SUMMARY OF THE INVENTION

In one manner of attaining these and other objects of the invention, a first body is releasably restrained against movement relative to a second body by a heat-responsive material which is arranged to prevent the first body from being released for moving to an operating position until the material is heated to a level where it is no longer capable of retaining the moveable body in an inactive position. In one way of practicing the invention, the release of the first body causes it to be forcibly driven against an impact-responsive explosive.

In another manner of achieving the objects of the present invention, a heat-responsive material is arranged between the tool body and a movable member on the tool to initially block movement of the movable member to an active operating position until the tool has been exposed to the elevated temperatures that are customarily encountered in a well bore sufficiently for the heat-responsive material to degrade sufficiently for releasing the detonating member so that it is free to be driven against the impact-responsive explosive when the well bore perforation is to be operated.

In yet another manner of practicing the present invention with a well bore perforate which carries one or more explosive devices, a movable detonating member is arranged to be selectively impelled against an impact-responsive explosive. The detonating member is initially restrained from moving in relation of the tool body by a heat-responsive material which remains effective until an electrical heater on the perforator is operated from the surface for heating the bonding material until the material melts or is at least sufficiently softened that it releases the detonating element when the tool is to be operated.

In addition to the selective actuators of the invention, donor and receptor explosives in detonating proximity of one another are initially isolated from one another by a heat-responsive material which is effective until it is heated to a temperature where the material can no longer attenuate the transmission of the detonation forces to the receptor explosive.

In yet another manner of carrying out the new and improved methods and apparatus of the invention, a barrier is formed of a substance that remains substantially solid below a predetermined temperature level and is interposed between an impact-responsive explosive and a movable detonator member cooperatively arranged to be selectively released from the surface. Accordingly, the explosive will be safeguarded against unwanted detonations until such time that the substance becomes sufficiently unstable that the barrier can no longer effectively prevent the movable member from striking the explosive with sufficient percussive force to detonate it. Furthermore, as an additional safeguard, by using impact barriers of selected substances, should the explosive not be detonated, subsequent recooling of those barriers below this temperature level will be effective for sufficiently restoring the substance that these barriers will effectively prevent an inadvertent detonation of the explosive by restraining the movable detonator member from being jarred against the impact-responsive explosive as the perforator is removed from the well bore.

BRIEF DESCRIPTION OF THE DRAWINGS

The novel features of the present invention are set forth with particularity in the appended claims. The invention along with still other objects and additional advantages thereof may be best understood by way of exemplary methods and apparatus which employ the principles of the invention as best illustrated in the accompanying drawings in which:

DESCRIPTION OF A PREFERRED EMBODIMENT OF THE INVENTION

Figure 1:
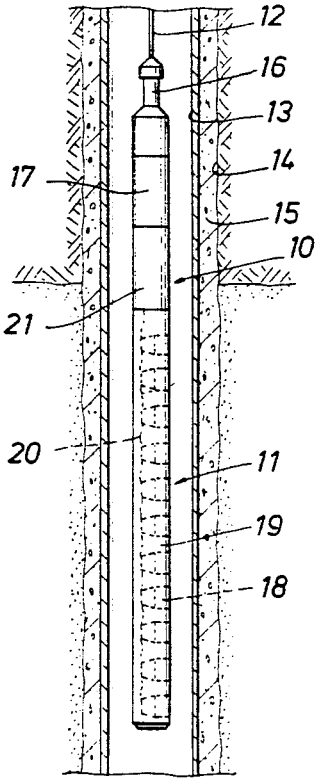
FIG. 1 schematically depicts a typical wireline perforation tool having an electrically-actuated system which is arranged in accordance with the principles of the invention to control the tool while practicing the methods of the invention.

Turning now to FIG. 1, as indicated generally at 10, a new and improved electrically-operated actuating system arranged in accordance with the principles of the invention is shown as it would be routinely utilized for controlling a typical wireline perforator 11. As illustrated, the wireline perforator 11 is dependently connected to the lower end of a typical suspension cable 12 which is spooled on a winch (not shown) at the surface which is selectively operated as needed for moving the tool through a casing 13 secured within a borehole 14 by a column of cement 15. The wireline perforator 11 is preferably coupled to the lower end of the suspension cable 12 by means of a typical rope socket or cable head 16 to facilitate the connection of the electrical conductors of the suspension cable to the explosive detonating system 10 of the invention. The wireline perforator 11 also preferably includes a typical collar locator 17 which is connected by way of the cable conductors to appropriate surface instrumentation (not illustrated) which is cooperatively arranged to produce characteristic signals that are representative of the depth locations of the tool as it is being moved past the collars in the casing string 13.

As will subsequently become apparent, it is to be understood that the electrically-operated actuating system 10 of the present invention is considered as being effective to initiate from the surface the operation of any perforator. However, in order to describe one preferred mode of practicing the invention, the electrically-operated actuating system 10 is illustrated as an electrically-initiated explosive detonating system which is uniquely arranged to control a well bore perforator 11 such as a typical wireline perforating gun. As depicted in FIG. 1, the well tool 11 is a typical perforating gun having a plurality of shaped explosive charges 18 respectively mounted at spaced intervals in a fluid-tight hollow body 19. To detonate these shaped charges 18, a typical detonating cord 20 carrying a suitable high explosive such as RDX is cooperatively arranged within the longitudinal bore in the tool body 19 so as to be in detonating proximity of each of the charges. It will, of course, be recognized that the tool 11 may be any type of perforator. Accordingly, it is to be understood that the electrically-initiated explosive detonating system 10 of the present invention is not considered as being restricted to use with only certain classes of well bore perforators much less to any particular type of well perforator.

Figure 2:
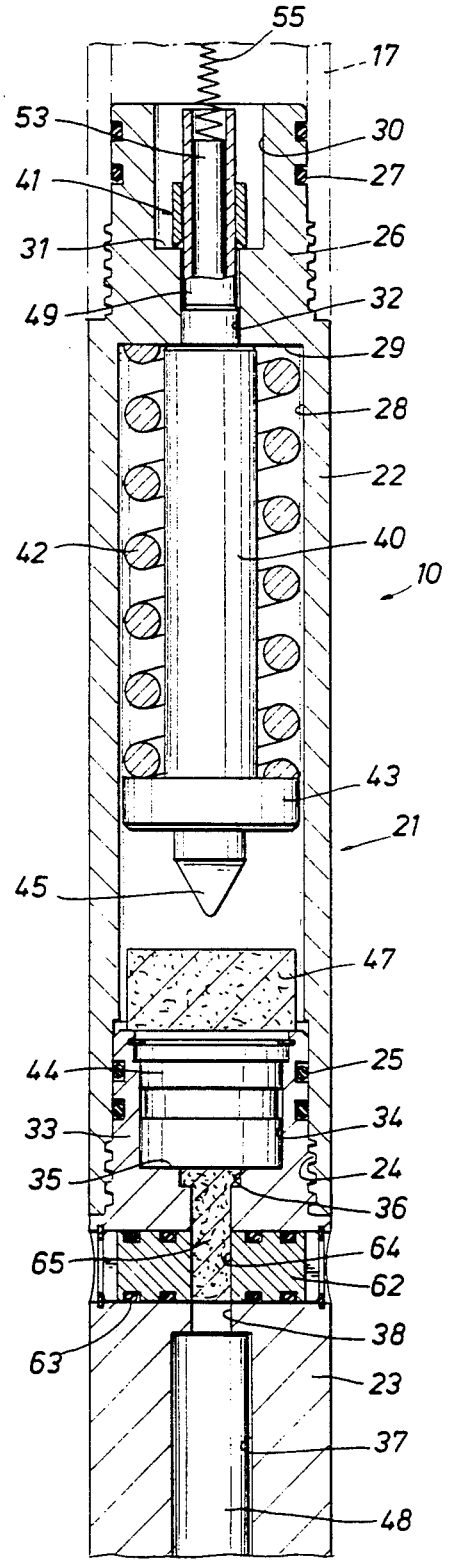
FIG. 2 is an enlarged, cross-sectioned elevational view of the electrically-actuated system seen in FIG. 1 and illustrates in more detail a preferred embodiment of that system arranged for a wireline perforator having one or more explosive devices.

Turning now to FIG. 2, the preferred embodiment of the new and improved electrically-initiated explosive detonating system 10 of the invention is shown as including an elongated tubular body 21 having a longitudinal axial bore. To facilitate the fabrication of the body 21 as well as the installation of the components of the detonating system 10 into the tubular body, the body is preferably arranged to comprise upper and lower sections 22 and 23 which are tandemly interconnected by complementary threads 24 and fluidly sealed in relation to one another by means such as one or more O-rings 25. The body 21 is arranged to be tandemly coupled to the other elements of the well bores perforator 11 by forming the upper body section 22 with an externally-threaded upright end portion 26 which carries sealing means, such as one or more O-rings 27, and is adapted to be complementally coupled to the matching female end portion of the collar locator 17. In a similar fashion, the lower end of the lower body section 23 is counterbored for providing an internally-threaded, downwardly-facing opening (not illustrated) in the lower end of the tool body 21 which is arranged to receive and be fluidly sealed in relation to the threaded upright end portion of the tool body 19 which is tandemly coupled therebelow.

As an alternative to the above-described two-part body 21, the perforator 11 could be configured with the upper end portion of the tool body 19 instead being arranged in the same manner as the lower body section 23 that is described herein so that the tool body 19 would be directly coupled to the upper body section 22. This alternative constructional arrangement would, of course, reduce the overall length of the well tool 11 should this be considered advantageous or necessary. It is, however, preferred to arrange the tool body 21 with its respective upper and lower sections 22 and 23 so that the explosive detonating system 10 of the present invention will be a completely self-contained unit that can be tandemly coupled into any well perforator. Accordingly, by arranging the explosive detonating system 10 as a self-contained, interchangeable unit in a single body as at 19, the operator can safely carry a supply of the previously-armed units to facilitate replacing an expended unit on any one of several well bore perforator that are being prepared for a subsequent operation.

Those skilled in the art will further appreciate that the practice of the invention is not dependent upon particular design details of the upper and lower end portions of the body sections 22 and 23 of the preferred embodiment of the detonating system 10 illustrated in the drawings. Nevertheless, in accordance with the objects of the invention, it is preferred that the upper and lower end portions of the tool body 21 be arranged in keeping with standard tool design criteria typically used in the oilfield industry to enable the electrically-actuated explosive detonating system 10 to be interchangeably utilized with any wireline perforator which has the same nominal outer diameter and comparable design operating conditions. By following these standard criteria, the detonating system 10 of the present invention can potentially be employed with a variety of perforators rather than having to be custom designed for use with only a few selected well bores perforators. The many advantages of making the new and improved detonating system 10 of the invention a universally-usable system are, of course, obvious to those with skill in the art.

As shown in FIG. 2, the longitudinal bore of the tubular upper body section 22 is enlarged to provide an elongated chamber 28 which is terminated near the upper end of the body section for defining a downwardly-facing shoulder 29 at the top of the inner chamber. The portion of the longitudinal bore of the upper body section 22 that extends through the upstanding end portion 26 of the body is counterbored to provide an upwardly-opening recess 30 terminated by an upwardly-facing shoulder 31 defining the lower surface of the recess. As depicted, the counterbored recess 30 is dimensioned so the upwardly-facing shoulder 31 is spatially disposed a short distance above the downwardly-facing shoulder 29 thereby leaving only a short reduced-diameter portion 32 of the longitudinal bore in the upper body section 22 extending between those two spatially-disposed shoulders found in the upper end of the upper body section.

The upper end of the lower body section 23 is provided with a reduced-diameter upstanding end portion 33 carrying the seals 25 that is arranged to be disposed in the open lower end of the enlarged-diameter longitudinal chamber 28 in the body section 22 and threadedly secured thereto by the threads 24. The portion of the longitudinal bore of the lower body section 23 which extends through its upstanding end portion 33 that is counterbored for a short distance to provide an upwardly-directed, enlarged-diameter opening 34 terminated with its lower face defining an upwardly-facing shoulder 35. The portion of this longitudinal bore below the upwardly-facing shoulder 35 formed in the enlarged opening 34 is itself preferably counterbored for defining a fairly shallow, upwardly-facing recess 36 in the lower surface of this enlarged opening 34. As illustrated in FIG. 2, the upper portion of the longitudinal bore of the lower body section 23 is also enlarged, as indicated at 37, to leave only a relatively-short, reduced-diameter portion 38 of the longitudinal bore in the upper body section 22 extending between the upwardly-directed opening 34 and the enlarged bore portion 37 in the upper portion of the lower body section.

The new and improved explosive detonating system 10 of the invention includes means selectively initiated from the surface for detonating an impact-responsive explosive. In the preferred embodiment of the detonating system 10, this is best accomplished by means such as an elongated movable impact or detonating member 40 which is coaxially disposed in the enlarged chamber 28 and is normally retained in an inoperative position by means such as an electrically-actuated release mechanism 41 that will be described subsequently in more detail by reference to FIG. 3. In keeping with the principles of the present invention, the electrically-actuated release mechanism 41 is operable for restraining the elongated member 40 from moving downwardly from its illustrated elevated position. Although the weight of the member 40 would be adequate in many cases to impel the elongated member downwardly upon the actuation of the release mechanism 41, it is preferred instead to provide a more-positive biasing force such as from a pressure actuator or a spring to be assured that the elongated member is forcibly driven. Accordingly, as illustrated in the drawings, in the preferred embodiment of the detonating system 10 of the invention the downwardly-imposed biasing force is provided by typical biasing means such as a stout coil spring 42 which is coaxially mounted around the elongated member 40 and initially maintained in compression between an enlarged-diameter shoulder 43 on the lower portion of the elongated impact member and the downwardly-facing surface 29 at the upper end of the chamber 28.

In accordance with the principles of the present invention, the compression spring 42 must be effective for forcibly driving the elongated body downwardly in the chamber 28 only in response to the selective actuation of the release mechanism 41 to effect the release of the depending impact member 40. In view of the substantial biasing force supplied by the spring 42, it will be recognized that as the detonating system 10 is being assembled, the coil spring may be mounted around the elongated member 40 and is maintained in its depicted compressed position by a suitable assembly tool (not illustrated) to keep the elongated member in its elevated position while the release mechanism 41 is being coupled to the upper end of the elongated member. Those skilled in the art will, of course, appreciate that the assembly of the impact member 40 and the release mechanism 41 must be carried out before threadedly coupling the upper and lower body sections 22 and 23 together.

A further task that must be carried out before the upper and lower sections 22 and 23 of the tool body 21 are coupled together is to install a typical percussion-actuated explosive initiator or impact-responsive primer cartridge 44 in the upwardly-opening recess 34 in the upper end of the lower body section. As shown in FIG. 2, the explosive primer cartridge 44 is cooperatively positioned in the lower body section 23 so as to be aligned with a pointed firing pin 45 dependently coupled to the lower end of the elongated member 40. As indicated at 46, a peripheral ring around the upper end of the cartridge 44 is clamped between the opposed surfaces defined by the upper end of the body section 23 and a downwardly-facing annular shoulder just inside the lower end of the chamber 28 to be assured that the cartridge will be secured against movement within the counterbored recess 34.

After the explosive primer cartridge 44 is installed in the recess 34, an impact-absorbing barrier 47 arranged in accordance with the principles of the present invention is positioned on top of the primer cartridge so as to be cooperatively interposed between the upper face of the primer cartridge and the lower tip of the firing pin 45 once the two body sections 22 and 23 are assembled. It will, therefore, be apparent that once the unique barrier member 47 has been installed and the upper and lower body sections 22 and 23 coupled together, the barrier will be retained in an impact-absorbing position between the firing pin 45 and the upper face of the primer cartridge 44. The significance of this positioning of the unique barrier 47 in the longitudinal movement path of the firing pin 45 will subsequently become apparent.

The explosive detonating system 10 of the present invention further includes means such as a typical train of explosives for detonating the several shaped charges 18 (FIG. 1) in response to the selective detonation of the primer cartridge 44. In the preferred manner of arranging this typical explosive train, an explosive booster charge 48 of a conventional design is disposed in the enlarged bore 37 in the upper end portion of the body 23 so that the upper end of the booster charge will be in detonating proximity of the primer cartridge 44. As is typical, the booster charge 48 is crimp-connected to the upper end of the detonating cord 20 (FIG. 1) which, as previously described, is positioned in detonating proximity of the shaped charges 18 in the tool body 19 dependently supported by the lower body 23. The respective components of the explosive train collectively represented by the primer cartridge 44, the booster cap 48 and the detonating cord 20 are, of course, cooperatively chosen for reliably detonating the shaped charges 18 (FIG. 1) whenever the elongated member 40 is selectively released for forcibly driving the firing pin 45 against the impact-sensitive upper face of the cartridge with the force that is imparted to the member 40 by virtue of the release of the stored energy in the contracted compression spring 42.

Figure 3:
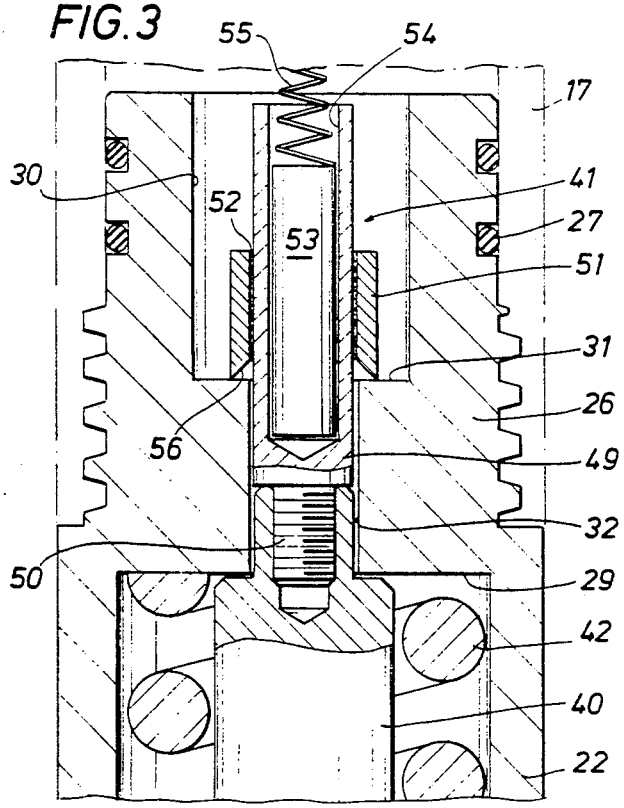
FIG. 3 is a cross-sectioned elevational view of the upper end of the detonating system depicted in FIG. 2 that has been further enlarged for better describing particularly significant aspects of this preferred embodiment of the present invention.

Turning now to FIG. 3, the release mechanism 41 of the new and improved electrically-actuated explosive detonating system 10 of the present invention is illustrated as it will appear while it is effectively securing the elongated member 40 in its initial elevated position as described above. In this depicted preferred embodiment of the electrically-actuated release mechanism 41, a short body 49 is coaxially disposed in the short bore portion 32 extending through the upstanding end 27 of the upper body 22; and the lower end of this short body is securely coupled to the upper end of the downwardly-biased elongated member 40 by means such as a depending threaded stud 50 on the short body that is threadedly engaged in a matching upwardly-facing threaded bore in the upper end of the elongated member. The coupling member 49 is supported on the upper body 22 by means such as an annular or tubular stop member 51 that is releasably bonded to the coupling member and positioned with the lower end of the stop member normally resting on the upwardly-directed face 31 of the counterbored recess 30 in the upstanding end portion 26 of the upper body section.

To selectively release the coupling member 49 from the stop member 51, the new and improved release mechanism 41 preferably includes means such as a thin layer 52 of a thermally-responsive bonding agent which is strong enough to normally bond these two members together and withstand the biasing force of the spring 42 until the agent has been heated to at least a predetermined temperature. In the preferred manner of selectively weakening or releasing the bonding agent 52 between the two members 49 and 51, the new and improved release mechanism 41 further includes means which are to be selectively initiated from the surface such as an encapsulated electrical heating element or a typical cartridge heater 53 which is cooperatively fitted in an upwardly-opening socket 54 in the upper portion of the upright coupling member. The heating capacity of the encapsulated cartridge heater 53 is, of course, selected to be more than adequate for degrading or weakening the particular bonding agent, as at 52, being used to releasably bond the coupling and stop members 49 and 50. Since the body of the encapsulated cartridge heater 53 will be in good electrical contact with the body 22 and the body elements of the well bores perforation 11, a typical central spring or contact 55 will suffice to establish electrical contact with a matching central contact member (not illustrated) in the collar locator 17 thereabove and, from the collar locator, to a conductor in the suspension cable 12. It will, of course, be recognized that, as an alternative, the heater 53 could also have electrical leads which would instead be connected to the appropriate conductors in the collar locator 17.

In the preferred manner of bonding the coupling member 49 to the stop member 49 and 51 to one another, it has been found that an ideal heat-responsive bonding agent is provided by a meltable alloy or solder such as various ones of the typical tin solders. In particular, it has been found that superior results will be attained by bonding the members 49 and 51 to one another by means of a commercial solder such as a typical antimonial tin solder (e.g., 95% Sn & 5% Sb) or a typical tin-silver solder (e.g., 95% Sn and 5% Ag) that respectively have excellent mechanical properties and moderate melting temperatures. It will be appreciated, of course, that the scope of the invention is to be considered as including other alternative bonding materials having acceptable properties such as typical lead-base solders, soft solders, precious metal solders as well as various low melting temperature fusible alloys such as alloys of bismuth with tin and/or lead which may also incorporate varying amounts of cadmium, indium and/or antimony. The only significant requirement is that the bonding material be such that an application of heat to the material would suffice to melt, weaken or otherwise degrade the heat-responsive material within a reasonable time period that the bonding strength of the material is no longer capable of holding the detonating member 40 against being moved downwardly by a biasing force such as provided by a pressure actuator or the spring 42.

These materials will, of course, have different melting points depending upon their respective composition. Therefore, the particular material used for the bonding agent 52 in a given tool will govern the output capacity of a given cartridge heater 53. The cartridge heater 53 must, of course, be of an adequate capacity to provide the amount of heat necessary for increasing the temperature of the bonding agent 52 to the level necessary for degrading, weakening or melting the agent within a reasonable period of time. There will, of course, be a significant amount of heat imparted to the explosive detonating mechanism 10 by way of the ambient temperature of the well bore fluids exterior of the tool body 22 as the perforator 11 is lowered into the well casing 13. Accordingly, by assuming how much heat will be imparted to the coupling member 49 by the time that the bore perforator 11 has reached a given depth, it will be possible to reasonably approximate the amount of additional time that the heater cartridge 53 must be energized before the biasing force of the spring 42 will be able to effect a release of the elongated member 40.

In the preferred embodiment of the new and improved release mechanism 41, the coupling member 49 is formed of copper and the tubular stop member 51 is formed of steel, with these two members being joined by a thin layer of one of the aforementioned solders 52. As illustrated at 56, it has been found particularly useful to bevel the lower edge of the stop member 51 for minimizing the unwanted transfer of heat into the upper body section 22. Heat transfer between the cartridge heater 53 and the adjacent wall of the coupling member 49 will, of course, be enhanced by sweat soldering the heater cartridge into the coupling member so as to provide good electrical and heat conductivity between the heater cartridge and the inner wall of the bore 54. By taking measures such as these to assure that there is good heat transfer between the cartridge heater 53 and the inner and outer members 49 and 51 and that most of the heat is being concentrated or directed into the bonding material 52, the output requirements for the heater will be correspondingly reduced so that a heater of relatively-small physical dimensions could be utilized. It should also be noted that the stop member need not be a tubular member, as shown at 51, but that a suitable stop member could alternatively be arranged as an elongated bar soldered on one side of the coupling member 49. Alternatively, a suitable stop member could also be provided by simply utilizing the bonding material 52 to form an outstanding shoulder or an enlarged projection on the exterior of the coupling member 49 that would be initially engaged against the upwardly-directed shoulder 31 until this projection either melts, softens or is otherwise degraded in response to the selective heating action of the cartridge heater 53.

Accordingly, it will be appreciated that once the well bore perforator 11 has been properly positioned at a desired depth location in the well casing 13, the cartridge heater 53 is then selectively initiated from the surface by connecting a power source (not illustrated) to the conductors in the suspension cable 12. The heater 53 is operated for a sufficient length of time to impart an amount of heat energy into the bonding material or solder 52 that will at least soften the solder. At some point during this application of heat to the solder 52, the bond between the two members 49 and 51 will become so weak that the bonding material will no longer be capable of withstanding or supporting the biasing force of the compression spring 42 on the elongated member 40. That will, of course, cause the release mechanism 41 to then function by releasing the elongated member 40. As noted above, once the bonding material softens or fails and thereby releases the elongated member 40 for moving from its initial inactive position, the biasing force provided by the compression spring 42 will be effective for forcibly driving the firing pin 45 downwardly along its longitudinal movement path toward the percussion detonator or primer cartridge 44.

It will be recalled, however, that the unique barrier 47 is interposed in this movement path when the tool bodies 22 and 23 are being assembled. It will be appreciated that so long as this unique barrier 47 is capable of either withstanding or limiting the penetration of the firing pin 45 into the barrier, the firing pin will be prevented from reaching the upper face of the primer cartridge 44. Similarly, so long as the unique barrier 47 is effective for at least attenuating or significantly absorbing the impact force which the compression spring 42 imposes on the pin 45, the firing pin will be incapable of imparting an impact force on the cartridge 44 that will detonate it. It must, therefore, be appreciated that in keeping with the objects of the present invention, the new and improved barrier 47 will reliably function to prevent the inadvertent detonation of the percussion detonator or cartridge 44 that would otherwise occur should the release mechanism 41 be accidentally or prematurely operated.

Nevertheless it must be appreciated that in keeping with the principles of the present invention, the barrier 47 is intended to provide this second measure of protection or safety only so long as it is considered reasonably necessary to prevent the premature actuation of the bore perforator 11. Protection against its premature actuation is obviously needed so long as the tool 11 is either at the surface or it has not yet reached a safe depth in the casing string 12 (FIG. 1) and it is still possible that voltage might somehow be unwittingly applied to the conductors in the cable 12.

Accordingly, in keeping with the principles of the present invention, it has been found that by preparing the unique barrier 47 from an unstable substance that will soften, melt, dissolve or disintegrate after being exposed for a reasonable length of time to the expected well bore temperatures, this unique barrier will temporarily prevent the untimely release of the elongated member 40 from detonating the primer cartridge 44. Thus, the barrier 47 will assure that the premature operation of the release mechanism 41 can not detonate the primer cartridge 44 until the barrier 47 is evaporated, weakened, softened or liquified by its exposure to the typical elevated temperatures of the well bore fluids that are in the casing string 13. The barrier 47 will, therefore, be effective until the material or substance comprising the barrier has deteriorated to the point that the release of the elongated member 40 will reliably drive the firing pin 45 into contact with the primer cartridge 44 to effect its detonation.

It will, of course, be appreciated that various materials and compositions, such as thermoplastics, which significantly soften or degrade when exposed for a short time to moderately-elevated ambient temperatures can be effectively employed for the impact-attenuating barrier 47. Nevertheless, as previously noted above, the objects of the invention are achieved if the barrier 47 is effective only until the well tool 11 is at a depth where the unwanted detonation of the explosive cartridge 44 will not represent a safety hazard. Accordingly, it is preferred that the barrier 47 be constructed of a material or substance that will lose its impact-attenuating or absorbing capacity at temperatures no greater than about 250° F. (i.e., about 125° C.). Those skilled in the art will, of course, appreciate that the large majority of wells do not contain well bore fluids with temperatures in excess of that temperature level. Moreover, in those wells which do contain well bore fluids in excess of 250° F. (125° C.), the higher temperatures are typically encountered only at extreme well bore depths. Thus, in keeping with the principles of the invention, it is preferred that the degradable material or substance used in the barrier 47 be rendered ineffective when its temperature is no greater than about 250° F. (125° C.). At times it will, of course, be essential to consider a lower temperature level should it be anticipated that the well bore temperatures at the selected depth interval of the particular operation will be fairly low. As a practical matter, therefore, it is preferred that the barrier 47 be formed from a substance or material that is rendered totally ineffective at a temperature in the order of 5°-50° F. (i.e., about 3°-30° C.) lower than the anticipated temperature of those well fluids which will be encountered at or above the selected depth interval for the particular service operation that is to be conducted by the well bores perforator 11.

Accordingly, in the preferred embodiment of the present invention disclosed herein, it has been found that low-melting or fusible alloys ideally meet every requirement for successfully practicing the present invention. The alloys are typically the binary, ternary, quaternary and quinary mixtures of bismuth, lead, tin, cadmium and indium or other metals. Those skilled in the art will, of course, recognize that many of these fusible alloys of bismuth are liquid at temperatures below the boiling point of water and a few of those alloys have melting points below 150° F. (i.e., about 65° C.). It should be noted that when these fusible alloys are eutectic alloys, these alloys will have a melting temperature that is lower than those of any of the component metals which they contain; and this melting temperature will remain constant. On the other hand, when these fusible alloys are non-eutectic alloys, they will also have lower melting temperatures than their respective components; but these melting temperatures will instead be variable depending upon various extrinsic conditions and factors. Accordingly, some of those non-eutectic alloys will have a range of melting points that will nevertheless be wholly acceptable for the impact-attenuating barrier 47 of the present invention.

Figure 4:
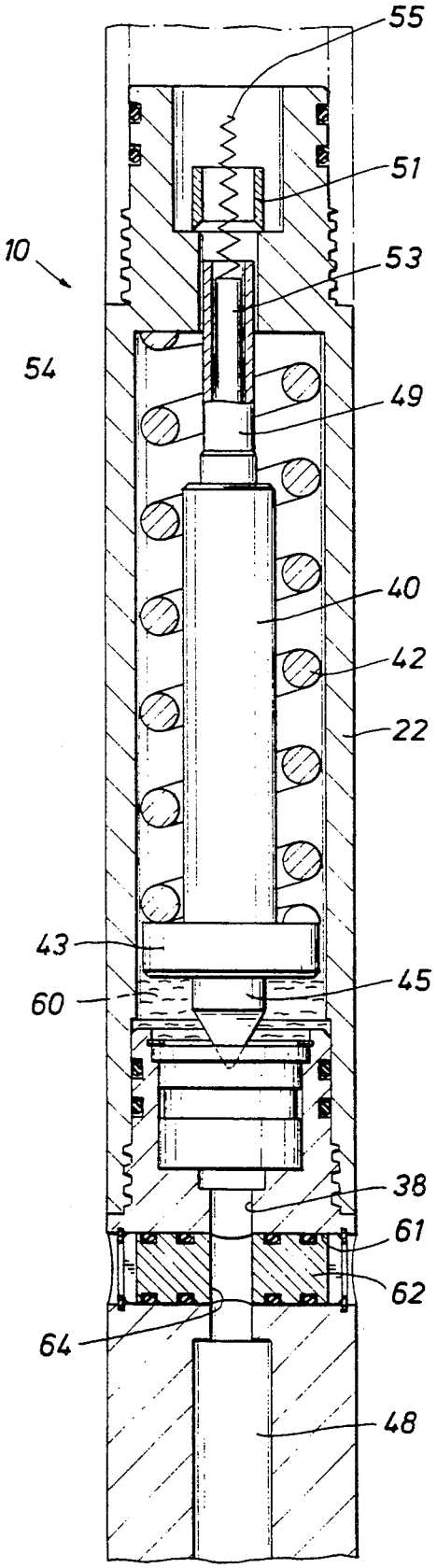
FIG. 4 is similar to FIG. 2 but depicts that system as it will appear after the system has been exposed to elevated temperatures for an extended period and a failed attempt was made to actuate the perforator.

As best seen in FIG. 4, once the composition or material in the barrier 47 has been completely melted or liquified, a pool of liquid, as at 60, will be left on top of the primer cartridge 44. Nevertheless, once the well-bores perforator 11 has been correctly positioned in the casing string 13 and the detonating system 10 selectively initiated, the melted barrier 47 will be incapable of preventing the impact force of the firing pin 45 from achieving detonation of the primer explosive 44.

The return of the perforator 11 will, however, present a potential hazard if the percussion detonator 44 failed to fire. Thus, as previously discussed, there is a significant hazard to the personnel on the rig floor that is ordinarily not discernible by inspection of the tool 11 as it is being lifted out of the well bore.

Accordingly, in keeping with the principles of the present invention, it has been found that by utilizing a thermoplastic polymer or one of the low-melting fusible alloys discussed above for constructing the barrier 47, elevated well bore temperatures exterior of the tool will initially degrade the barrier as the tool 11 is being lowered into the casing string 13. Then, once the barrier 47 becomes a liquid pool, as at 60, the selectively-initiated detonating system 10 can be used to fire the gun 11. On the other hand, should it be necessary to return the tool 11 to the surface without the primer explosive 44 having been detonated for any reason, as the tool is raised through well bore fluids of lower temperatures, the liquid pool 60 will be cooled during the return to the surface and thereby resolidified so to ultimately restore the barrier 47 to its approximate original state. If, for example, the firing pin 45 had been released while the barrier 47 was melted and it is now sitting on top of the primer explosive, once the liquid resolidifies, the tapered tip of the pin will be confined in a complemental cavity which supports the firing pin against further downward movement against the primer explosive 44 as the well bore perforator 11 is being returned from the well bore. This added support might well be sufficient to prevent the primer explosive 44 from being accidentally fired by rough handling as the perforator 11 is raised out of the well bore. Moreover, should it happen that the detonating member 40 carrying the firing pin 45 is still not released, the resolidification of the barrier 47 will insure that a subsequent release of the detonating member for any reason will be totally ineffective for detonating the primer explosive 44. Hereagain, it must be recognized that the paramount thrust of the present invention is to take every measure to prevent untimely detonation of any explosive device on a tool whether that tool is the perforator 11 with one or more shaped charges 18 or any other well bore perforator that would represent a potential risk should explosives on that perforator be inadvertently detonated. Thus, the resolidification of the unique barrier 47 simply provides still another unique measure of protection. It is of great significance that by using a meltable material, this barrier 47 is one of several safety devices which, in keeping with the principles of the invention, are utilized to prevent untimely actuation of any perforator, as at 11, having one or more explosive devices.

As a further safety precaution, it will be noted from the drawings that a lateral passage 61 intersecting the longitudinal bore 38 is provided in the lower body 23 and that a cylindrical spool 62 is rotatably mounted in that passage and fluidly sealed by means such as O-rings 63 around each end of the spool. A transverse passage 64 is conveniently located in the mid-portion of the cylindrical spool 62 so that when the spool is in its illustrated explosive "arming" position, the passage will be axially aligned with the longitudinal bore 38 in the tool body 23. This "arming" position of the spool 62 will, of course, allow explosive forces from the primer explosive 44 to be freely transmitted through the passage 64 to the booster charge 48. It will also be recognized that when the spool 62 is rotated so as to carry the transverse passage 64 out of alignment with the bore 38, the spool will be in a "disarming" position to effectively prevent the transmission of a high-order detonating force between the primer charge 44 and its associated booster charge 48.

It will, of course, be recognized that the spool 62 must be left in the illustrated "arming" position so long as the charges 18 are to be detonated. Accordingly, in keeping with the objects of the present invention, a meltable plug 65 is complementally fitted in the bore 38 and the transverse passage 64 through the spool 62 for providing a temporary barrier which will serve to prevent the premature detonation of the booster charge 48 until the meltable plug has had sufficient time to melt by virtue of a prolonged exposure to the well bore environment. The melting of the temporary barrier 65 will, of course, allow the meltable material to drain into the longitudinal bore 38 and thereby clear the transverse passage 64 of the impediment to the detonation wave. Once the transverse passage 64 is cleared of the barrier 65, the detonation wave produced by the primer cartridge 44 will, of course, be capable of going through the passage and detonating the booster charge 48 at high order. It should be appreciated that the spool 62 and/or the barrier 65 could just as well be cooperatively arranged in other locations in the detonating train and function equally well.

It will, of course, be recognized that the barrier plug 65 can be constructed of a variety of heat-responsive materials or substances which would be reliably melted by relatively-low well bore temperatures such as described above by reference to the barrier 47. Aside from the requirement that it be capable of attenuating detonating forces while it is still in the solid state, the only other thing which is essential for the material or substance used for the plug 65 is that it will become a low-viscosity fluid at low well bore temperatures to be certain that the liquified material will readily flow out of the spool passage 64 and down into the space around the booster charge or detonator 48. Accordingly, in the preferred embodiment of the detonation-attenuating plug 65, it is preferred to use one of the various low-melting fusible alloys described above by reference to the barrier 47.

Nevertheless, it will be recognized that when the perforator 11 is returned to the surface with the cartridge 44 still unfired, the spool 62 can be easily turned to its safe or "disarming" position as the upper end of the Perforator 11 emerges from the well bore for insuring that the detonator charge 48 will not be inadvertently detonated. Since the explosive detonating system 10 will normally be positioned above the body 19, the spool 62 can be safely rotated by placing a screwdriver in a transverse slot 66 on either end of the spool and rotating the spool to its "disarming" position while any explosive devices that may remain in the tool 11 will be confined in the well bore. In this way, there is never a time when the tool is being removed from the well bore that the detonator cartridge 44 is not disarmed.

It should be noted that FIG. 2 depicts the barrier 65 as being an integral member having an enlarged head and an elongated stem passing completely through the transverse passage 64 in the spool 62. The illustrated arrangement of the barrier 65 makes it necessary, therefore, that the spool 62 remain in its depicted "arming position" so that the barrier itself provides the above-described safety feature before lowering the tool 11 into the well bore. It should be noted, however, that an alternative arrangement would utilize a two-part barrier that would have an enlarged head and a short stem in the housing passage 38 and a separate plug in the transverse passage 64. That two-part design would allow the spool 62 to be initially placed in its "disarming position" without disrupting the barrier 65. Then, at some time before the tool 10 is lowered into the well bore, the spool 62 would be rotated to align the transverse passage 64 with the bore 38 and, for the first time, align the short stem of the barrier 65 with the separate plug in the transverse passage. Hereagain, it must be recalled that in keeping with the principles of the invention, the new and improved explosive detonating system 10 is uniquely arranged to provide redundant protective safeguards to prevent untimely detonation of one or more explosive devices on the well bore perforator 11.

Figure 5:
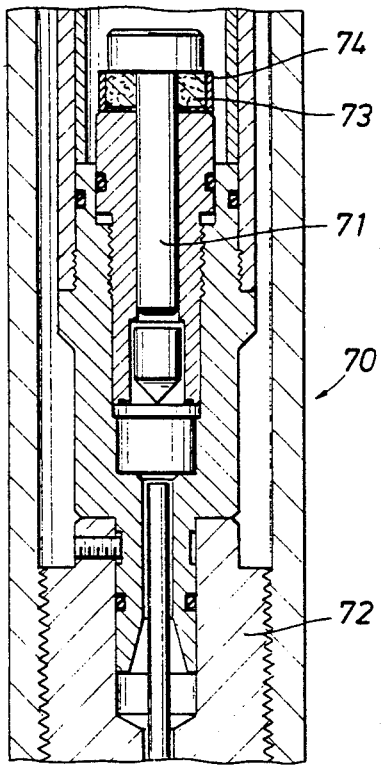
FIG. 5 shows another preferred embodiment of a new and improved perforator incorporating the principles of the invention that may be employed for practicing the methods of the invention.

Turning now to FIG. 5, another embodiment of the present invention is depicted as it would be employed for safeguarding a so-called "tubing conveyed perforator" which is not selectively initiated by a surface source of electrical power. It is, of course, quite common to utilize these so-called "TCP perforators" by dependently coupling the perforator to a tubing joint and then lowering the perforator into a well bore as the supporting tubing string is progressively assembled. These TCP perforators are, of course, well known and the particular design of the perforator is entirely outside of the scope of the present invention. The TCP perforators as shown, for example, in U.S. Pat. No. 4,509,604, U.S. Pat. No. 4,610,312 or U.S. Pat. No. 4,611,660 are each representative of the large variety of TCP perforators utilizing impact-actuated detonating trains which could be safeguarded in keeping with the principles of the present invention.

Once the TCP perforator is at a desired depth location in a well bore, it is then selectively initiated from the surface either by dropping a so-called "drop bar" through the tubing string or by varying the pressure inside of the tubing string and in the well bore until a predetermined pressure level or pressure differential is reached. In either case, the initiation of these TCP perforators will either release or forcibly drive a movable detonating member against an impact-responsive explosive with sufficient force to detonate it. Many TCP perforators also have the capability of being alternatively initiated by way of pressure variations as well as by a drop bar.

It will, of course, be appreciated that TCP perforators are relatively unaffected by many of the aforementioned hazards that are associated with electrically-initiated well bore perforators as at 11. Nevertheless, regardless of the particular design of a given TCP perforator, it will be recognized that the principles of the present invention can also be utilized in conjunction with any TCP perforator or well bore perforator utilizing a moveable member that is to be driven against an impact-responsive explosive.

Accordingly, as shown in FIG. 5, the upper portion of a typical TCP perforator 70 is illustrated with the upper end of a firing pin 71 that is arranged in the body 72 of the tool to be releasably retained in its depicted inactive or elevated position by heat-responsive release means such as a meltable block or degradable stop member 73 which is disposed between opposing surfaces on the firing pin 71 and the tool body 72. As discussed previously it must, of course, be understood that the particular heat-responsive substance used for the stop member 73 will depend upon the anticipated well bore temperatures surrounding the perforator 70 as it is being lowered into a well bore. Thus, in keeping with the principles of the present invention, it will be necessary to form the stop member 73 from any one of the above-described heat-responsive materials which will be dissolved, softened, disintegrated, melted or substantially weakened in response to relatively short-term exposures to the moderately-elevated temperatures generally encountered in typical well bores.

Regardless of the material or substance chosen for the heat-responsive stop member 73, as the perforator 70 is lowered into a well bore, the moderately-elevated temperature of the well bore fluids exterior of the perforator will soon degrade the stop member; and this block of temperature-responsive material will no longer be effective for preventing the downward travel of the firing pin or detonating member 71. Once the degradable member 73 has weakened, it will then be possible to selectively initiate the perforator 70 from the surface. Hereagain, as previously discussed, the particular design of the perforator 70 will, of course, determine whether the tool is to be selectively initiated from the surface by dispatching a drop bar through the tubing string to strike the detonating member 71 or by varying the fluid pressures in the tubing string and/or well bore as appropriate to operate that particular tool.

In keeping with the principles of the present invention, it must be realized that there will be situations where it will be necessary to remove the perforator 70 from a well bore without having attempted to actuate it either by releasing a drop bar or by fluid-pressure actuation. Thus, should the perforator 70 have been exposed to well bore temperatures over a length of time that was sufficient to melt, disrupt, degrade or in any way render the stop member 73 sufficiently fluent, it is essential that the stop member 73 be restored to its initial state if it is to again be effective for stopping downward travel of the detonating member 71 as the perforator is removed from the well bore. Accordingly, as illustrated in FIG. 5, in the preferred embodiment of the present invention it is preferred to contain the degradable stop member 73 in a frangible or flexible receptacle such as shown at 74. In this manner, once the heat-responsive substance of the stop member 73 becomes disintegrated, impaired or melted by the elevated well bore temperatures, the receptacle 74 will prevent the substance from flowing or falling away from its safe-guarding position under the enlarged head of the detonating member 71. Thus, in the event that the tool 70 is to be withdrawn from the well bore without the perforator having been fired, as the tool is raised into lower temperature zones in the well bore the heat-responsive substance forming the barrier 73 will be resolidified and thereby restore the perforator to its initial safe-arming status.

It should bew noted that the TCP perforator 70 could also be equipped with a heat-responsive barrier (such as shown at 47 in FIG. 2) for absorbing the impact of the detonating member 71 until elevated well bore temperatures exterior of the tool render the heat-responsive barrier ineffective in the same fashion as described above by reference to FIGS. 2 and 4. Similarly, the TCP perforator 70 could be equipped with an "arming/disarming" spool (such as shown at 62 in FIG. 2) should it be considered advantageous to provide still another level of safety for the perforator.

Accordingly, it will be seen that the present invention has new and improved methods and apparatus for selectively initiating various perforators from the surface. In particular, the present invention provides new and improved explosive detonating systems which are unaffected either by extraneous electromagnetic signals or by spurious electrical energy while the perforators are at the surface. Morevoer, the present invention provides new and improved methods for safreguarding perforators with explosive devices from inadvertent detonation and for selectively initiating these perforators only after the perforators have reached a safe position by rendering the explosive inoperable until those perforators have been exposed to elevated well bore temperatures for a finite time period. The methods and apparatus of the invention further render these perforators inoperable should they be returned thereafter to the surface without having been operated properly.

While only particular embodiments of the present invention and modes of practicing the invention have been described above and illustrated in the drawings, it is apparent that changes and modifications may be made without departing from the invention in its broader aspects; and, therefore, the aim in the claims which are appended hereto is to cover those changes and modifications which fall within the true spirit and scope of the invention.

What is claimed is:

1. A well perforator to be suspended in a well bore and comprising:

a fixed body;

an impact-acuated explosive on said fixed body;

a movable body arranged on said fixed body to be impelled against said impact-actuated explosive for detonating said explosive;

first means for retaining said movable body in an inactive position on said fixed body including a heat-responsive material arranged between said bodies initially retaining said movable body in its inactive position until subsequent heating of said heat-responsive material renders it incapable of retaining said movable body in its said inactive position; and second means selectively initiated from the surface and operable for impelling said movable body against said impact-actuated explosive to detonate said impact-actuated explosive only after heating of said heat-responsive material has rendered said heat-responsive material incapable of retaining said movable body in its said inactive position.

2. The well perforator of claim 1 further including a barrier formed of a heat-responsive substance that is solid only at temperatures below anticipated well bore temperatures cooperatively arranged on said fixed body to initially prevent said movable body from being impelled to detonate said impact-actuated explosive and which subsequently becomes ineffective as elevated well bore temperatures exterior of said well perforator effect a change in said heat-responsive substance for thereafter rendering said barrier ineffective to prevent said movable body from being impelled to detonate said impact-actuated explosive.

3. The well perforators of claim 1 including barrier means between said movable body and said impact-actuated explosive which is formed of a heat-responsive substance that remains solid only up to a predetermined temperature level less than the anticipated well bore temperatures for attenuating the impact force of said movable body to prevent detonation of said impact-actuated explosive should said movable body be impelled against said impact-actuated explosive before elevated well bore temperatures exterior of said well perforator have heated said heat-responsive substance above its said predetermined temperature level.

4. The well perforator of claim 3 where said heat-responsive substance is restored to its initial solid state whenever its temperature is subsequently lowered below said predetermined temperature level in response to reduced well bore tempertures exterior of said well perforator for rendering said barrier means effective to attenuate the impact force of said movable body for preventing detonation of said impact-actuated explosive should said well perforator be removed from a well bore before said impact-actuated explosive are detonated; said heat-responsive substance being selected from the group consisting of low-temperature fusible metal alloys and thermoplastic polymers respectively having melting temperatures that are less than said anticipated well bore temperatures.

5. The well perforator of claim 1 wherein said second means include an electrical heating element on one of said bodies for heating said heat-responsive material until it is incapable of retaining said movable body in its said inactive position on said fixed body.

6. The well perforator of claim 5 where said heat-responsive material is a meltable material arranged on one of said bodies adjacent to said electrical heating element for initially restraining the movement of said movable member against said impact-actuated explosive; said meltable material being selected from the group consisting of antimonial tin solders, tin-silver solders, lead-tin solders, alloys of bismuth and tin, alloys of bismuth and lead, and alloys of bismuth with cadmium, indium and antimony which weaken when said meltable material is heated to elevated temperatures approaching its melting point.

7. The well perforator of claim 6 further including a solid barrier between said movable body and said impact-actuated explosive and which is formed of a heat-responsive substance that remains solid only at temperatures below anticipated well bore temperatures for absorbing the impact force of said movable body and which becomes ineffective as elevated well bore temperatures exterior of said well perforator effect a change in said heat-responsive substance that renders said barrier ineffective for absorbing the impact force of said movable body so that the detonation of said impact-actuated explosive can be thereafter achieved.

8. The well perforator of claim 5 wherein said second means include biasing means operable for forcibly impelling said movable body against said impact-actuated explosive once said electrical heating element has heated said heat-responsive material to a temperature where said heat-responsive material becomes incapable of retaining said movable body in its said inactive position on said fixed body.

9. The well perforator of claim 8 wherein said biasing means include a spring cooperatively arranged between said bodies for normally imposing a biasing force on said movable body and then forcibly impelling said movable body once said heat-responsive material becomes incapable of retaining said movable body in its said inactive position on said fixed body.

10. The well perforator claim 1 wherein said second means include an impact member releasable from the surface to strike said movable body and thereby impelling said movable body against said impact-actuated explosive only after elevated well bore temperatures exterior of said well perforator raise said heat-responsive material to a temperature where it no longer retains said moveable body in its said inactive position on said fixed body.

11. The well perforator of claim 10 further including a heat-responsive barrier formed of an impact-absorbing substance that is initially solid below a predetermined melting temperature for preventing the release of said impact member from impelling said movable body against said impact-actuated explosive, said barrier means being rendered ineffective to absorb impact forces as elevated well bore temperatures exterior of said well perforator have heated said impact-absorbing substance above its said predetermined melting temperature to effect a change in said impact-absorbing substance to thereafter enable said movable body to be impelled to detonate said impact-actuated explosive.

12. The well perforator of claim 11 wherein said heat-responsive barrier is disposed between said movable body and said impact-actuated explosive.

13. The well perforator of claim 10 further including first and second opposed surfaces respectively arranged on said bodies and which are normally spaced from one another; and wherein said heat-responsive material is formed of a solid block mounted between said opposed surfaces for initially blocking the movement of said movable member toward said impact-actuated explosive, said block being formed of a heat-responsive material having a melting point less than said anticipated well bore temperatures and is selected from the group consisting of low-temperature fusible metal alloys and thermoplastic polymers.

14. The well perforator of claim 13 including an impact-absorbing barrier on said fixed body which is formed of a heat-responsive substance operative so long as said heat-responsive substance remains below a predetermined temperature level for rendering said barrier effective to prevent the release of said impact member from detonating said impact-actuated explosive.

15. The well perforator of claim 14 wherein said heat-responsive substance is selected from the group consisting of thermoplastic polymers and metal alloys having melting points which are less than said anticipated well bore temperatures.

16. The well perforator of claim 13 including an impact-absorbing barrier between said movable body and said impact-actuating explosive and formed of a heat-responsive solid rendering said barrier effective to prevent detonation of said impact-actuated explosive until said heat-responsive substance has been heated above its melting temperature by elevated well bore temperatures as said well perforator is being lowered into a well bore, said heat-responsive solid being subsequently restored to its solid state as it is cooled below its said melting temperature by reduced well bore temperatures as said well perforator is being raised out of a well bore rendering said barrier again effective to prevent the inadvertent detonation of said impact-actuated explosive.

17. The well perforator of claim 16 wherein said heat-responsive substance is selected from the group consisting of thermoplastic polymers and metal alloys having melting points which are less than said anticipated well bore temperatures.

18. A method for performing a well perforating operation with a perforating tool having an actuator movable on the body of the tool from an initial inactive position to a final operating position and comprising the steps of:

securing a heat-degradable material between said actuator and said tool body for releasably retaining said actuator in its said inactive position until said heat-degradable material is heated to a predetermined temperature for degrading said heat-degradable material;

lowering said tool into a well bore containing well fluids at elevated temperatures which are greater than said predetermined temperature for conducting a well perforating operation at a selected depth interval therein; and selectively initiating the movement of said actuator to its said final operating position from the surface for carrying out said well perforating operation at said selected depth interval only after the elevated temperatures of said well fluids have degraded said heat-degradable material sufficiently that said actuator is no longer retained in its said initial operating position.

19. A method for perforating a well bore with a perforating gun carrying an impact-actuated detonator coupled to an explosive perforating device and having an impact-imparting actuator which is movable on the body of said perforating gun from an inactive position to an impact-imparting position for detonating said impact-actuated detonator and comprising the steps of:

securing a heat-responsive meltable material between said actuator and said gun body for releasably retaining said actuator in its said inactive position;

positioning said perforating gun at a selected depth interval in a well bore for carrying out a perforating operation; and heating said meltable material to a temperature approaching the melting point of said meltable material for releasing said actuator for movement to its said impact-imparting position to detonate said impact-actuated detonator and said explosive perforating device while said perforating gun is positioned at said selected depth interval.

20. The method of claim 19 wherein said heating of said meltable material is carried out by the elevated temperatures of well bore fluids exterior of said gun body as said perforating gun is being positioned at the selected depth interval and further including the step of selectively initating the movement of said actuator from the surface for detonating said impact-actuated detonator after said actuator has been released for movement from its said inactive position.

21. The method of claim 19 wherein said heating of said meltable material is carried out by a surface-controlled heater on said gun body adjacent to said meltable material and further including the step of selectively initiating the heating of said meltable material from the surface after said perforating gun has been positioned at the selected depth interval for detonating said impact-actuated detonator when said actuator has been released for movement from its said inactive position.

22. A method for perforating a selected well bore interval with a perforating gun carrying an impact-actuated explosive detonator coupled to an explosive perforating device and including an actuator which is movable on the body of said perforating gun from an inactive position to an active position for detonating said impact-actuated explosive detonator and said explosive perforating device and comprising the steps of:

positioning a heat-degradable barrier on the body of said perforating gun for blocking movement of said actuator to its active position;

positioning said perforating gun at a selected depth interval in a well bore where the elevated temperature of well bore fluids will degrade said barrier to render said barrier ineffective for thereafter blocking movement of said actuator; and once said barrier has been rendered ineffective, selectively initiating the movement of said actuator to its impact-imparting position for detonating said explosive detonator and perforating device.

23. The method of claim 22 wherein said barrier is positioned between said actuator and said explosive detonator.

24. The method of claim 23 wherein said movement of said actuator is selectively initiated from the surface.

25. A method for perforating a selected well bore interval with a perforating gun carrying an impact-actuated explosive detonator coupled to an explosive perforating device and including an impact-imparting actuator which is movable on the body of said perforating gun from an inactive position to an impact-imparting position for detonating said impact-actuated explosive detonator and said explosive perforating device and comprising the steps of:

releasably retaining said actuator in its inactive position by means of a heat-degradable material;

positioning a heat-degradable impact-attenuating barrier between said actuator and said explosive detonator;

positioning said perforating gun at a selected depth interval in a well bore where the elevated temperature of well bore fluids will degrade said barrier to render said barrier ineffective for thereafter attenuating the impact forces of said actuator; and once said barrier has been rendered ineffective and said heat-degradable material has released said actuator, initiating the movement of said actuator to its impact-imparting position for detonating said explosive detonator and perforating device.

26. The method of claim 25 wherein said actuator is releasably retained in its inactive position by a block of a heat-meltable composition between said body and said actuator and the melting of said composition is carried out by the elevated temperature of well bore fluids as said perforating gun is being positioned at the selected depth interval and including the additional step of:

selectively initiating the movement of said actuator from the surface after said perforating gun is positioned at the selected depth interval for detonating said impact-actuated detonator and perforating device when the elevated temperature of well bore fluids has rendered said heat-degradable block incapable of restraining said actuator from moving away from its inactive position.

27. The method of claim 25 wherein said actuator is releasably restrained in its said inactive position by a meltable solder between said body and said actuator and melting of said solder is carried out by a surface-controlled electric heater on said body adjacent to said solder and including the additional step of:

selectively initiating said electric heater from the surface after said perforating gun is positioned at the selected depth interval for detonating said impact-actuated detonator when the electric heater heats the solder to a temperature approaching its melting point.

* * * * *